United States Patent [19]

Baumstingl

[11] 4,133,162

[45] Jan. 9, 1979

[54] PROCESS AND MEANS FOR PREFORMING CONTAINERS OR CARTONS FROM A TUBE WHICH IS FORMED OF A MATERIAL WHICH CAN BE AUTOMATICALLY WELDED BY PRESSURE

[75] Inventor: Herbert Baumstingl, Tremelo, Belgium

[73] Assignee: Papeteries de Belgique, Brussels, Belgium

[21] Appl. No.: 830,039

[22] Filed: Sep. 2, 1977

Related U.S. Application Data

[63] Continuation-in-part of Ser. No. 669,678, Mar. 23, 1976, abandoned.

[51] Int. Cl.[2] ..... B65B 9/12

[52] U.S. Cl. ..... 53/450; 53/548

[58] Field of Search ..... 53/28, 180 R, 180 M, 53/182 R, 182 M

[56] References Cited

U.S. PATENT DOCUMENTS

| | | | |
|---|---|---|---|
| 2,530,400 | 11/1950 | Rado | 53/28 X |
| 3,300,944 | 1/1967 | Thesing | 53/28 |
| 3,320,718 | 5/1967 | Thesing et al. | 53/180 |
| 3,388,525 | 6/1968 | Thesing | 53/28 X |

*Primary Examiner*—Travis S. McGehee

*Attorney, Agent, or Firm*—Richards, Harris & Medlock

[57] ABSTRACT

Process and means for preforming containers from a tube which is formed of a material which can be automatically welded by pressure and which contains a liquid. The means comprises half-moulds for preforming containers mounted in series on two endless chains on opposite sides of the tube and displaced towards one another for gripping and temporarily holding the tube therebetween, a pair of welding jaws acting above the half-moulds for gripping therebetween the walls of the tube and welding said walls to one another at the point of separation of the container and a means for separating the preformed containers. The means includes a second pair of welding jaws, disposed beneath the first pair and controlled in synchronism with the first pair, the second pair of jaws acting on a section of the tube welded at the top and bottom by the first pair of jaws, so as to provide an intermediate weld.

11 Claims, 5 Drawing Figures

PROCESS AND MEANS FOR PREFORMING CONTAINERS OR CARTONS FROM A TUBE WHICH IS FORMED OF A MATERIAL WHICH CAN BE AUTOMATICALLY WELDED BY PRESSURE

CROSS REFERENCE TO RELATED APPLICATION

This application is a continuation-in-part of co-pending application Ser. No. 669,678 filed Mar. 23, 1976, now abandoned.

BACKGROUND AND SUMMARY OF THE INVENTION

The present invention relates to a process for preforming containers or cartons from a tube formed of a material which can be automatically welded by pressure and containing a liquid, according to which process the filled tube is lowered between two endless series or trains of opposite half-moulds which are caused to descend simultaneously onto the tube for successively gripping the latter. The tube is subjected to the compression of welding jaws for welding it transversely during the descending movement of the half-moulds, after which the preformed container or carton is separated and the two half-moulds are spaced apart from one another.

One process of this type is known, according to which the containers are welded and separated from the tube individually by a single pair of jaws and a cutting means.

Until now, this process does not permit a container production rate which is satisfactory.

It has been found that it would be of interest to increase the rate of production in a same flow production.

It has also been established that it has not so far been possible during manufacture to adjust the volume of the containers when the volume thereof had already been chosen.

The object of the present invention is to overcome these disadvantages

With the container-preforming process according to the invention, the containers of the tube are first welded in sections corresponding to two preformed containers by a pair of upper jaws and then welded individually by a pair of lower jaws.

It is possible by this process to double the speed of descent of the tube between the half-moulds, and as a result to double the rate of production of the containers or cartons, thereby making possible production rates of the order of 5,000 containers per hour.

In accordance with one feature of the invention, the walls of the tube filled with liquid are pressed against the angular walls of the half-moulds while the tube descends into the first lower angular part of the half-moulds at a speed which is slightly greater than the speed of descent of the half-moulds and then descends at a speed substantially equal to that of the half-moulds in the straight section thereof, in order then once again to descend at a speed slightly higher than the speed of the half-moulds in the upper angular part thereof.

According to one embodiment of the invention, the speed of descent of the tube is regulated in relation to the speed of descent of the half-moulds by acting periodically on the spacing between the walls of the tube situated above the half-moulds, as a function of the height of the latter.

Thus, the walls of the tube are tightly applied to the walls of the half-moulds so as to be adapted with force to the shape of the latter, in order to obtain a volume which corresponds to the volume determined by the half-moulds.

According to another feature, the volume of the containers is adjusted by regulating the spacing of the opposite half-moulds.

The present invention also has for its object a means for continuously carrying out the process of preforming containers of different volumes, and for adjusting these volumes.

According to the invention, the means comprise a second pair of welding jaws constantly disposed beneath the first pair and controlled in synchronism with the first pair. The second pair of jaws acts on a section of the tube which was welded top and bottom by the first pair of jaws, in order to provide an intermediate weld.

DESCRIPTION OF THE DRAWINGS

Other details and features of the invention will become apparent from the description of the drawings accompanying the present specification, which represent diagrammatically one constructional form of the invention, simply by way of example.

DETAILED DESCRIPTION

Figure 1:
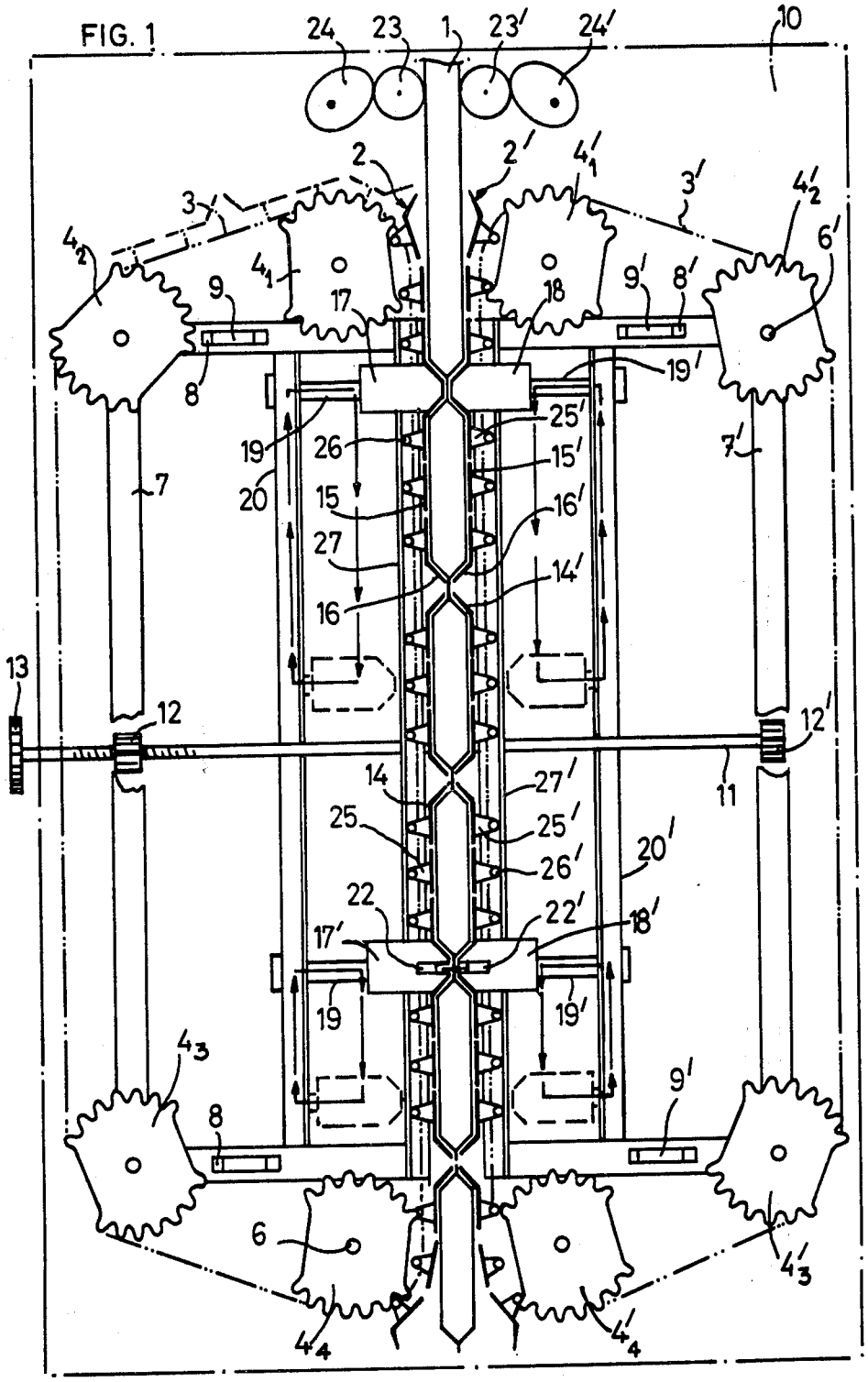
FIG. 1 is a diagrammatic view to a reduced scale and in front elevation of a means according to the invention.
Figure 2:
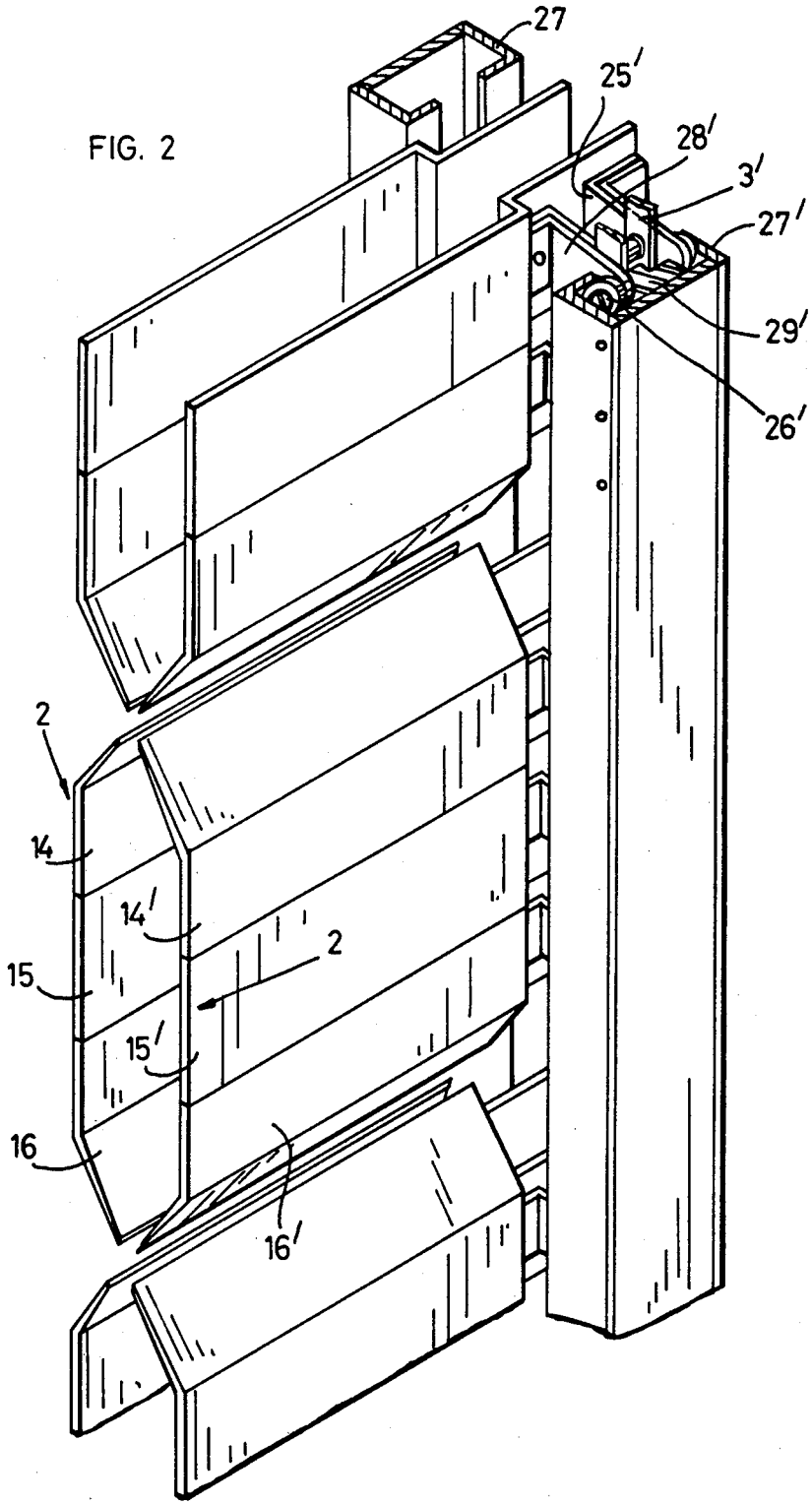
FIG. 2 is a perspective view of a detail of the means.

In these Figures, the same reference numerals represent identical elements.

As can be seen from FIG. 1, the tube 1, filled with a liquid, for example sterilized milk, is made in a manner known per se of a material which welds automatically by pressure under heat. Advantageously employed is a flexible material of the "sandwich" type, formed of at least one layer of a synthetic plastic material, such as polyethylene. Also in known manner, the tube is provided with longitudinal and transverse folding lines or grooves which correspond to the folding lines of the containers or cartons to be formed.

The filled tube is lowered continuously between two endless series or trains of opposite pairs of half-moulds 2, 2' for preforming containers, having together and per pair a substantially hexagonal vertical section. These half-moulds are mounted in series on two endless chains 3, 3' on either side of the tube 1. These chains are each mounted on two pairs of toothed wheels $4_1$, $4_2$, $4_3$, $4_4$ and $4'_1$, $4'_2$, $4'_3$, $4'_4$, respectively, and driven by a power source (not shown) operating on the external toothed wheels $4_2$ and $4'_2$. The wheels are carried by shafts 6, 6' fixed on separate frames and 7 and 7', respectively. These frames are disposed in the same vertical plane and the spacing thereof relative to one another is adjustable. For this purpose, frames 7 and 7' have slotted guides 8, 8' which fit on lugs or studs 9, 9' carried by a single fixed support 10. The two frames 7, 7' are interconnected by a threaded rod 11 fitting into nuts 12, 12' which are fast with said frames. By rotation of knurled wheel 13 at the end of the rod 11, it is possible to regulate the spacing between the frames 7, 7' and consequently the spacing between the chains 3, 3' and the half-moulds carried by said chains. This adjustment of the spacing between the half-moulds permits the volume occupied by the containers to be modified.

Figure 3:
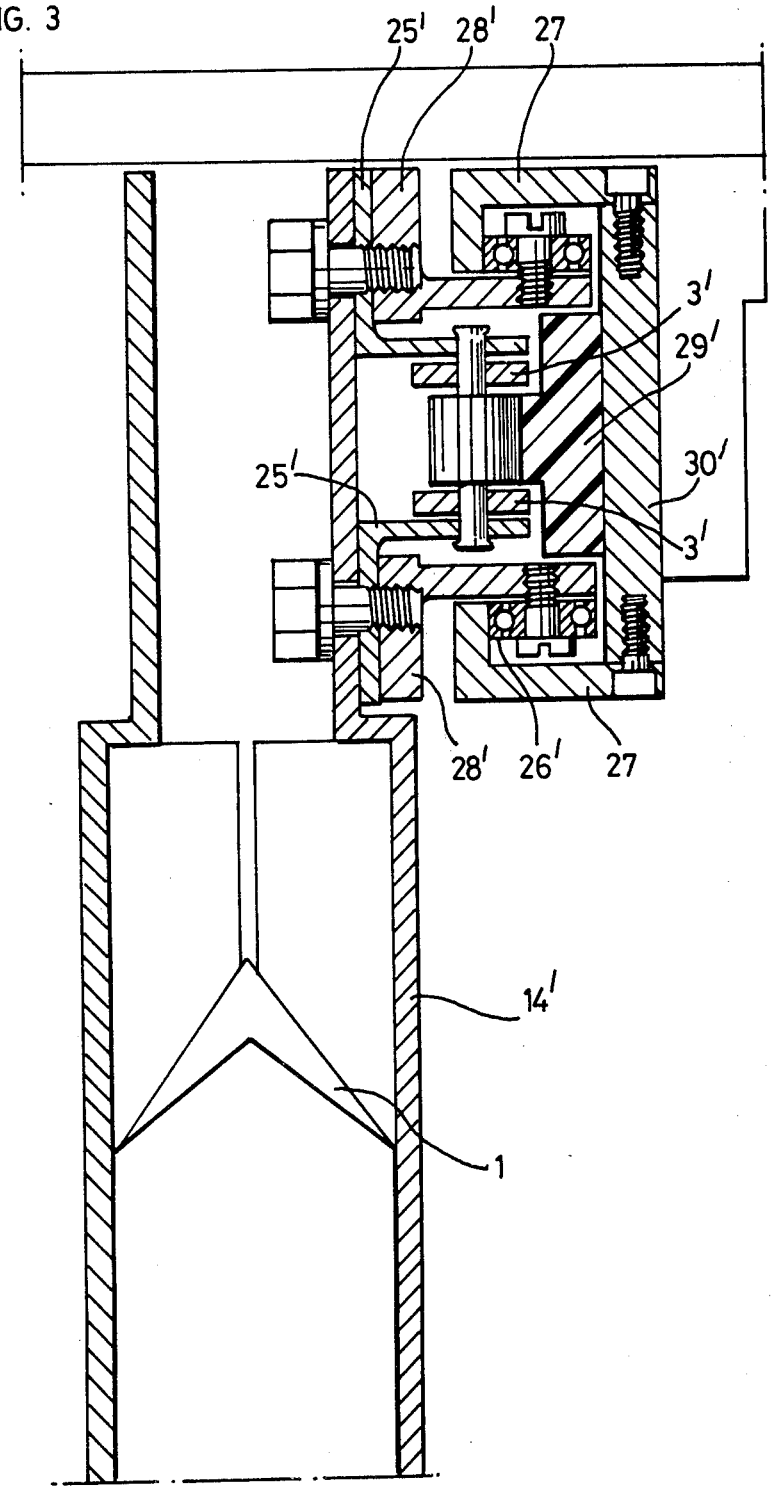
FIG. 3 is a detailed view to a larger scale of FIG. 2.

Each half-mould 2, 2' is formed from plates of sheet metal having three adjacent flat faces 14, 15 and 16 and 14', 15' and 16', which are independent of one another. The two end faces 14, 16 and 14', 16', respectively, are inclined towards the tube 1 and formed between them a means for constricting the tube. In addition, these end inclined faces form with the inclined faces of the following half-moulds a seating and guiding means for the first transverse welding jaws 17 and 18. As shown in detail in FIG. 3, the plates 14, 15, 16 and 14', 15', 16', respectively, forming the half-moulds, are fixed on the chains 3 and 3', respectively, by means of angle irons 25, 25' and bearings 28, 28', interconnected by screws and provided with rolling means 26, 26', which are guided in a vertical rail 27, 27'. The chains 3, 3' slide on a resin rolling track 29, 29' in the bottom plate 30, 30' of the rail 27, 27'.

The position of the folding lines in the tube corresponds substantially to the folding edges of the half-moulds, so that when the half-moulds are in a position close to one another, the container is gripped and preformed along the folding lines.

Figure 4:
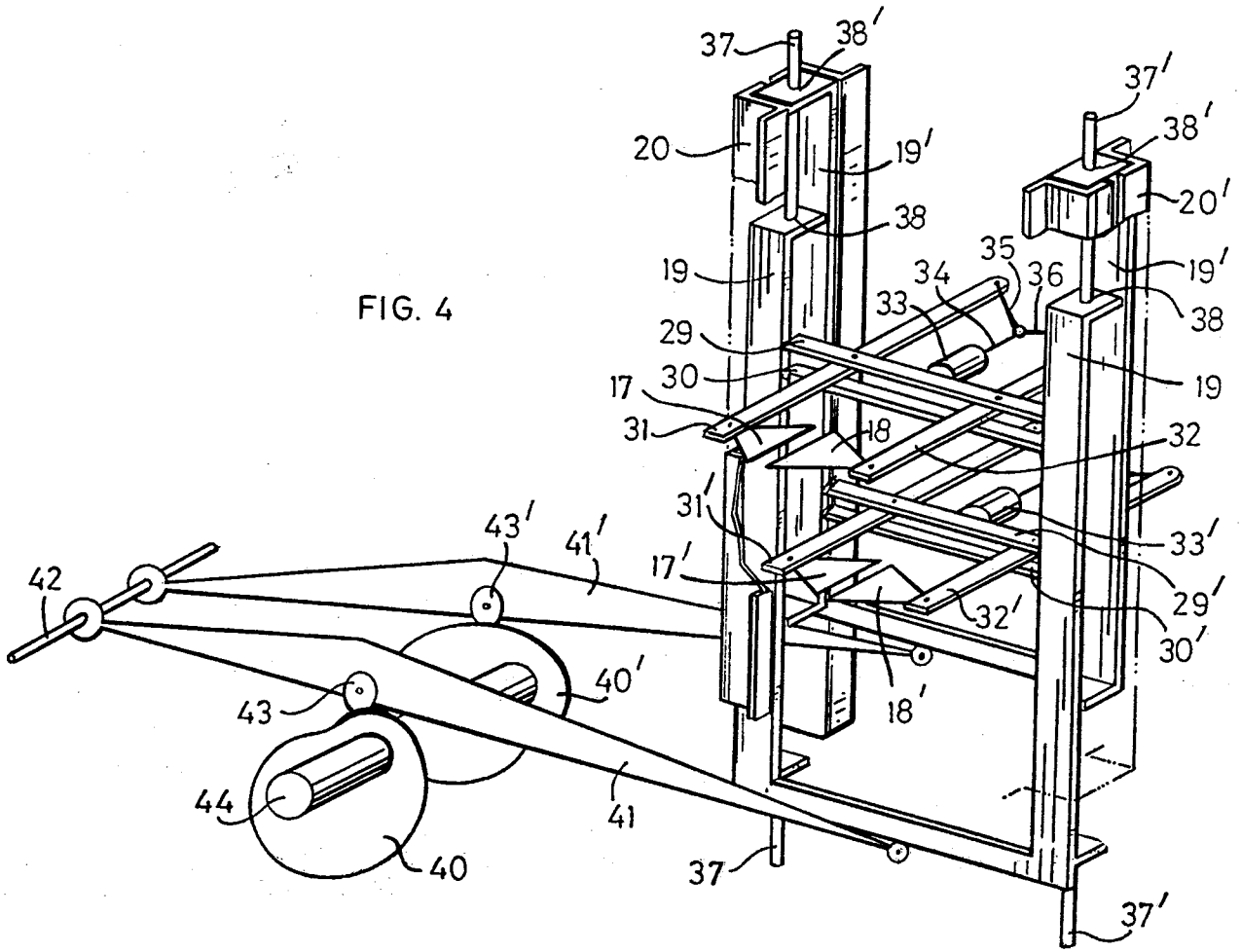
FIG. 4 is a perspective view of the means for operating the jaw means vertically.

Referring to FIGS. 1 and 4, a second pair of welding jaws 17', 18' is situated beneath the first pair at a distance permitting the tube to be welded in sections corresponding to two preformed containers by the first pair of jaws 17, 18, after which the containers are welded individually by the second pair of jaws 17', 18'. The jaws 17, 18 and 17', 18' are provided with guiding and driving means for horizontal and vertical operation around the paths denoted by arrows in FIG. 1. Accordingly, in brief, the jaws 17, 18 and 17', 18' are carried by frame shaped supports 19, 19', respectively, each having two C-shaped uprights, a lower cross-bar and two spaced upper cross-bars welded to said uprights as is best shown in FIG. 4. The frames slide toward each other on rods 37, 37' fixed on frame 19 passing through holes 38' provided in frame 19' engaged in vertical rails 20, 20'. Said jaws and supports are displaced vertically by the action of levers 41, 41' articulated on a rod 42 supported by a structure (not shown) and provided with cam followers 43, 43' mounted on the levers. Cams 40, 40' are operated by a shaft 44 rotated by driving means (not shown). The jaws 17, 18 and 17', 18' are displaced horizontally toward each other by means of links 31, 32 and 31', 32' pivotally mounted between the cross-bars 29, 30 and 29', 30', respectively. Links 31, 32 and 31', 32' are operated by hydraulic plungers 33, 33', respectively, whose rods are pivotally connected to said links by arms 35, 36 and 35', 36' in known manner on the support. Jaws 17, 18 and 17', 18' are provided with heating and cutting means 22, 22' for welding the tube and cutting it through the weld. For the sake of simplicity, cutting means 22, 22' are illustrated only in lower jaw means 17', 18'.

Figure 5:
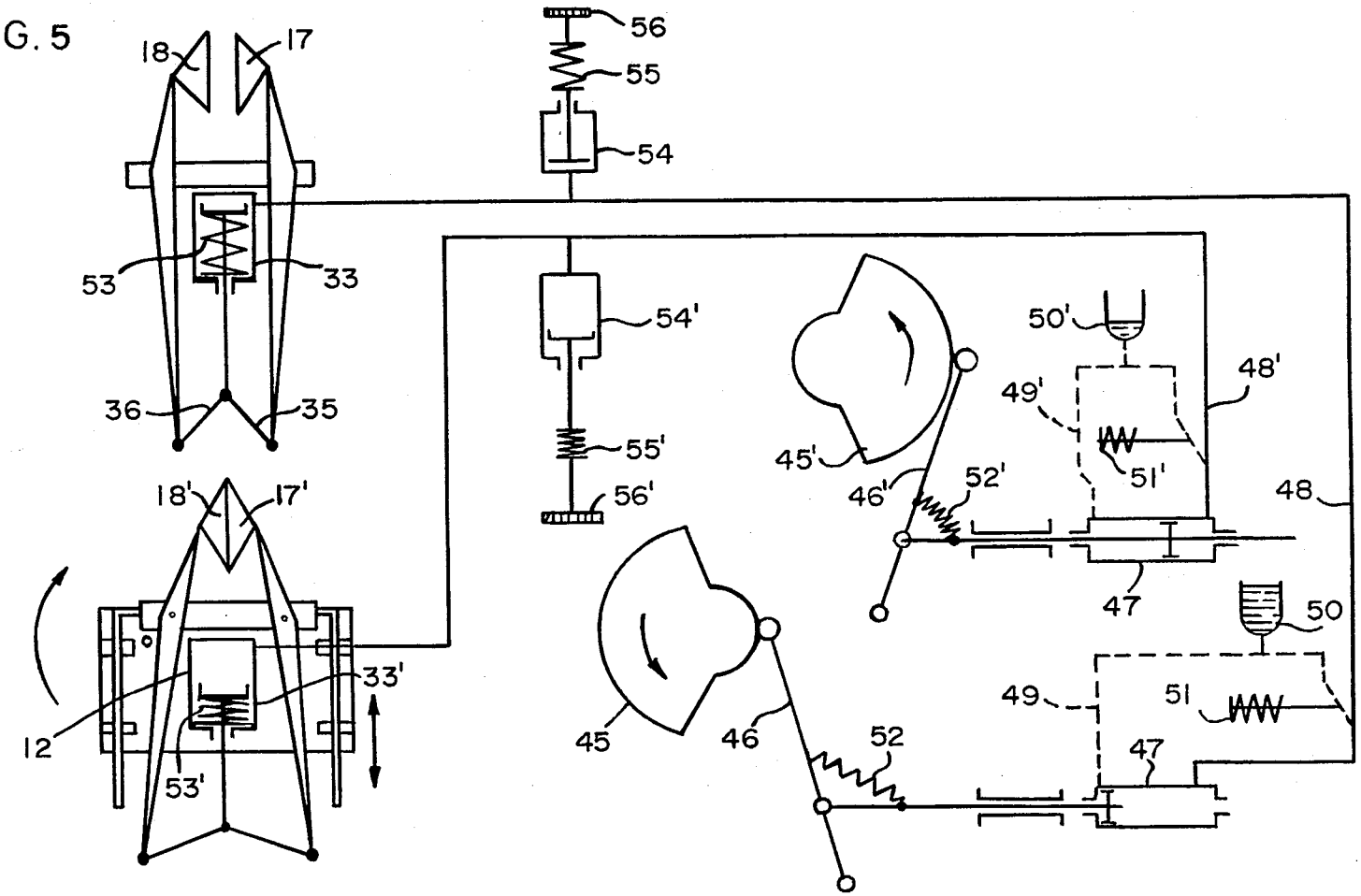
FIG. 5 is a schematic illustration of the means for operating the jaw means horizontally.

Referring now to FIG. 5, there is shown schematically the hydraulic mechanism for operating the jaws horizontally. The upper jaws 17, 18 are shown in the opened position, while the lower jaws 17', 18' are depicted in the gripping position. The operating mechanism comprises cams 45, 45', which operate levers 46, 46', which in turn move the pistons of pumps 47, 47' connected to the mainlines 48, 48' feeding the hydraulic cylinders 33, 33', and through auxiliary lines 49, 49' to containers 50, 50'. Auxiliary lines 49, 49' are further connected to mainlines 48, 48'; electromagnetic valves 51, 51' mounted on said auxiliary lines are provided to insure free circulation of the hydraulic fluid in the event of disengagement of the device when operating other equipment in which the device is only one of the constituent elements.

The jaws 17, 18 and 17', 18' are brought into the gripping positions by rotation of cams 45, 45' so as to actuate levers 46, 46' in the appropriate direction, so that the motion of the pistons in pumps 47, 47' force the hydraulic fluid out of the cylinder of said pumps and through mainlines 48, 48' into cylinders 33, 33', which in turn actuate arms 31, 32 and 31', 32' through tie rods 35, 36 and 35', 36' to achieve the desired closing motion of the jaws.

To open the jaws, cams 45, 45' are rotated to actuate levers 46, 46' in a generally counterclockwise direction under the action of springs 52, 52' so that the pistons of pumps 47, 47' draw the hydraulic fluid out of mainlines 48, 48' and cylinders 33, 33'. Under the action of springs 53, 53' inside cylinders 33, 33' arms 31, 32 and 31', 32' are actuated to open jaws 17, 18 or 17', 18'. The hydraulic fluid aspired by pumps 47, 47' flows through auxiliary lines 48, 48' into containers 50, 50'.

Auxiliary cylinders 54, 54' having springs 55, 55' and adjusting screws 56, 56' compensate for accidental pressure increases in mainlines 48, 48' during the cutting operation.

The welding jaws are displaced in synchronism and at the same rate of descent as that of the half-moulds, so as to insure the continuous descent of the tube between the half-moulds simultaneously with the transverse welding of the tube during this descent.

The welding jaws have a forward vertical section which corresponds substantially the the vertical section formed by the inclined end faces 14, 16 and 14', 16' of the half-moulds, so that these jaws are able to penetrate into the seating formed by these inclined faces and to be driven by the latter during the welding operation, during the descent of the half-moulds and tube.

Mounted above the half-moulds for guiding the filled tube are rollers 23, 23', the spacing of which is regulated by cams 24, 24' as a function of the height of the half-moulds.

In operation, the tube 1 filled with liquid is caused to descend continuously between two endless series of opposite half-moulds 2, 2', which are caused to descend simultaneously with the tube by actuation of the endless chains in the direction of the arrows. In order to press the filled tube against the angular walls of the half-moulds, the tube descends into the moulds at a speed which is regulated by the clearance or play of cams 24 and 24'. In the lower angular part of the half-moulds, the tube descends at a speed which is slightly greater than the speed of said moulds; in the straight section of the moulds, the tube is moved downwardly at substantially the same speed as that of the half-moulds; and in the upper angular part of the moulds, the tube descends at a speed slightly greater than the speed of the molds and preferably at the same rate of descent of the tube as that in the lower part of the half-moulds. The end faces of the first pair of half-moulds progressively approach the walls of the tube and define the location of the future welding. During this descending movement, the welding jaws are engaged, while they are themselves displaced downwardly in the seating formed by the end faces of the successive half-moulds, with which they are driven downwardly for welding and cutting the containers during movement in this position. The upper pair of jaws 17, 18 separates the containers in pairs, after welding only alternate seams, while the lower pair of jaws 17', 18' which include cutting means 22, 22' welds the alternate unwelded seams and separates the containers individually.

When it is desired to modify the volume of the containers which are being formed, the spacing which separates the half-moulds is modified by causing a turning movement of the threaded rod 11 by actuation of knurled wheel 13. When the transverse welds are made, the containers continue to be supported by the half-moulds until they are discharged, which occurs when the moulds are spaced apart, in order to be directed then toward a container-finishing station as known per se, which does not form the subject of the present invention.

It is quite clear that the invention is not exclusively limited to the constructional forms which are illustrated in that modifications may certainly be incorporated as regards the formation, arrangement and construction of certain of the elements participating in the operation thereof, without departing from the scope of the present invention, providing that these modifications are not inconsistent with each of the following claims.

What is claimed is:

1. A method of preforming containers from a tube containing a liquid and constructed of a material which can be welded by presure, comprising the steps of:

(a) advancing a filled tube downward between two endless trains of opposite half-moulds;

(b) moving said trains of half-moulds around predetermined paths so that opposite counterpart portions of the moulds simultaneously approach and progressively engage the walls of the tube to shape a series of containers to be formed, with the end portions of adjacent half-moulds defining together transverse welding seats between each set of half-moulds at the junctions between the containers;

(c) compressing and welding transverse portions of the tube with a first opposite jaw means during descent of the half-moulds at alternate welding seats to form welded seams defining tube sections corresponding to two containers;

(d) separating said sections of the tube through the welded seams made by the first jaw means to disconnect each section corresponding to two containers;

(e) compressing and welding transverse portions of each section corresponding to two containers with a second opposite jaw means at the other alternate welding seats during descent of the half-moulds to divide said sections into pairs of containers connected by intermediate welded seams;

(f) separating each pair of containers through the intermediate welded seams made by the second jaw means to disconnect the individual preformed containers; and (g) moving said trains of opposite half-moulds around predetermined paths so that opposite counterpart portions thereof simultaneously withdraw and progressively disengage the individual preformed containers.

2. The method of claim 1 wherein step (d) is preformed concurrently with step (c).

3. The method of claim 1, wherein step (f) is performed concurrently with step (e).

4. A method of preforming containers from a tube containing a liquid and constructed of a material which can be welded by pressure, comprising the steps of:

(a) moving two endless trains of opposite half-moulds around predetermined mould paths including portions adjacent to a predetermined tube path at substantially constant predetermined rates;

(b) said half-moulds each comprising an upper angular portion, a straight central portion, and a lower angular portion;

(c) continuously advancing the filled tube downward along the tube path between the moving trains of half-moulds at a variable predetermined rate;

(d) engaging the tube with the opposite corresponding lower angular portions of the half-moulds while the tube descends at a rate relatively greater than the rate of the half-moulds;

(e) engaging the tube with the opposite corresponding straight central portions of the half-moulds while the tube descends at a rate substantially equal to the rate of the half-moulds;

(f) engaging the tube with the opposite corresponding upper angular portions of the half-moulds while the tube descends at a rate relatively greater than the rate of the half-moulds;

(g) compressing and welding transverse portions of the tube with at least one pair of opposite jaw means to weld the tube at spaced locations therealong during engagement with the half-moulds to form a series of containers connected by welded seams;

(h) separating the individual preformed containers at the welded seams therebetween during engagement with the half-moulds; and (i) successively disengaging the opposite corresponding lower, central, and upper portions of the half-moulds from the descending preformed containers to individually release the containers.

5. The method of claim 4, wherein step (c) is accomplished by:

drivingly engaging the tube with predetermined cam means as a function of the length of the half-moulds to regulate the rate of descent of the tube in relation to the rate of movement of the trains on half-moulds.

6. An apparatus for preforming containers from a tube containing a liquid and constructed of a material which can be welded by pressure, comprising:

a descending tube;

two endless chain means disposed on each side of the tube and mounted for movement around predetermined paths including portions adjacent to the tube;

opposite half-mould means each comprising a lower angular portion, a straight middle portion, and an upper angular portion;

said opposite half-mould means being mounted in series on the endless chains to define welding seats between the upper and lower portions of adjacent half-moulds and so that the sides of the descending tube are successively approached with opposite corresponding portions of the half-moulds;

first movable jaw means for engaging and compressing the tube to form a welded seam between alternate half-mould means;

means for separating the welded seams formed by the first jaw means to disconnect sections of the tube corresponding to two containers;

second jaw means positioned below and operated in synchronism with the first jaw means for engaging and compressing the tube between the other alternate half-mould means to form intermediate welded seams between the seams made by the first jaw means; and means for separating the intermediate welded seams formed by the second jaw means to divide the sections of the tube corresponding to two containers into individual containers.

7. The apparatus of claim 6 wherein the first jaw means and the second jaw means are each mounted on separate actuating members.

8. The apparatus of claim 6, wherein the means for separating the intermediate welded seams formed by the second jaw means is integral with the second jaw means.

9. The method of claim 6, wherein the first jaw means and the second jaw means are received between the adjacent upper and lower portions of alternate half-moulds, which define welding seats, and carried downwardly therewith during the welding operation for a predetermined portion of the movement of said half-moulds on said endless chain means.

10. The apparatus of claim 6, wherein the spacing between the portions comprising each half-mould mounted on the endless chain means is selectively adjustable to change the internal volumes of the containers formed from the tube.

11. The apparatus of claim 6, further including:

a pair of spaced feed rollers positioned on opposite sides of the tube path prior to the endless chain means and mounted for horizontal translation into engagement with the tube;

cam means for driving the feed rollers so that the tube is periodically advanced as a function of the length of the half-moulds.

* * * * *

UNITED STATES PATENT AND TRADEMARK OFFICE

CERTIFICATE OF CORRECTION

PATENT NO. : 4,133,162

DATED : January 9, 1979

INVENTOR(S) : Herbert Baumstingle

It is certified that error appears in the above-identified patent and that said Letters Patent are hereby corrected as shown below:

Column 5, line 65, change "preformed" to --performed--.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*